US008123424B2

(12) United States Patent
Chang

(10) Patent No.: US 8,123,424 B2
(45) Date of Patent: Feb. 28, 2012

(54) INK FEEDER FOR FELT-TIP INK PEN

(75) Inventor: Hung-Jen Chang, Taipei (TW)

(73) Assignee: Lion Pencil Co., Ltd., New Taipei (TW)

( * ) Notice: Subject to any disclaimer, the term of this patent is extended or adjusted under 35 U.S.C. 154(b) by 464 days.

(21) Appl. No.: 12/411,178

(22) Filed: Mar. 25, 2009

(65) Prior Publication Data

US 2010/0247224 A1 Sep. 30, 2010

(51) Int. Cl.
*B43K 5/00* (2006.01)

(52) U.S. Cl. ..... 401/205; 401/198; 401/196

(58) Field of Classification Search ..... 401/196, 401/198, 199, 202, 205, 206
See application file for complete search history.

(56) References Cited

U.S. PATENT DOCUMENTS 5,332,326 A * 7/1994 Hori ..... 401/148
5,615,963 A * 4/1997 Kobayashi ..... 401/206
6,406,205 B1 * 6/2002 Hu ..... 401/205
6,488,429 B2 * 12/2002 Korper ..... 401/186
7,086,799 B1 * 8/2006 Pappageorge et al. ..... 401/206

* cited by examiner

*Primary Examiner* — David J. Walczak
*Assistant Examiner* — Jennifer C Chiang
(74) *Attorney, Agent, or Firm* — Pai Patent & Trademark Law Firm; Chao-Chang David Pai

(57) ABSTRACT

An ink feeder for a felt-tip ink pen and communicable with an ink reservoir defined in the ink pen includes a main body made of a rigid material to internally define a feeding bore; a plurality of micro raised portions radially inward protruded from and circumferentially spaced along an inner wall surface of the main body for clamping a felt tip of the ink pen in place; and a plurality of ink feeding clearances each being formed between two adjacent ones of the micro raised portions and communicable with the feeding bore, so that ink stored in the ink reservoir of the ink pen is fed to the felt tip via the ink feeding clearances. The rigid main body and other ink pen components can be assembled to form the ink pen in an automated manner, and the ink feeding clearances ensure smooth ink feeding without the risk of leakage.

3 Claims, 5 Drawing Sheets

INK FEEDER FOR FELT-TIP INK PEN

FIELD OF THE INVENTION

The present invention relates to an ink feeder, and more particularly to an ink feeder for a felt-tip ink pen.

BACKGROUND OF THE INVENTION

An ink pen is internally provided with an ink reservoir for storing an amount of ink therein. When using the ink pen to write, the ink in the ink reservoir is supplied to a felt tip of the ink pen via an ink feeder, so that a user can write with the felt tip.

FIG. 1 is a fragmentary longitudinal sectional view showing a conventional ink feeder mounted in a conventional felt-tip ink pen. As shown, the conventional ink feeder is usually a ring-shaped sponge 11 mounted around a felt tip 12. The ring-shaped sponge 11 communicates with an ink reservoir 13 in the ink pen, so as to absorb ink from the ink reservoir 13 and then feeds the ink to the felt tip 12 for writing.

The above-described felt-tip ink pen with an ink feeder made of a ring-shaped sponge 11 has the following disadvantages in terms of its manufacture and use: (1) the ring-shaped sponge is a very soft and flexible member and accordingly, could not be handled along with other components using a machine on an automated production line to assemble the ink pen. For instance, it is impossible to keep the ring-shaped sponge non-deformed when it is clamped and delivered by a robot for the purpose of completing automated assembly of the ink pen. Therefore, the soft ring-shaped sponge must be manually handled during the assembly, and it is of course troublesome and time-consuming to do so. (2) When the ink feeder made of the ring-shaped sponge is saturated with ink, the absorbed ink tends to leak out of the ink pen to result in lowered writing quality.

Therefore, due to the above-mentioned reasons, the conventional felt-tip ink pen and the sponge-made ink feeder thereof is not ideal in terms of their applicability.

SUMMARY OF THE INVENTION

A primary object of the present invention is to provide an ink feeder for felt-tip ink pen that can be conveniently handled to allow automated assembly of a felt-tip ink pen.

Another object of the present invention is to provide an ink feeder for felt-tip ink pen that does not cause ink leakage.

A further object of the present invention is to provide an ink feeder for felt-tip ink pen that has good applicability.

To achieve the above and other objects, the ink feeder for felt-tip ink pen according to the present invention is communicable with an ink reservoir in the ink pen, and includes a main body made of a rigid material and internally defining a feeding bore; a plurality of micro raised portions radially inward protruded from and equally spaced along an inner circumferential wall surface of the main body to together clamp a felt tip of the ink pen therebetween; and a plurality of ink feeding clearances each being formed between two adjacent ones of the micro raised portions and communicating with the feeding bore to enable feeding of ink to the felt tip via the ink feeding clearances. With the rigid main body thereof, the ink feeder along with other components can be handled with a machine to complete automated assembly of the ink pen. And, with the plurality of ink feeding clearances, the ink can be fed to the felt tip without the risk of causing any ink leakage.

Preferably, the felt-tip ink pen includes:

a felt tip cap having a first end portion and a second end portion opposite to each other;

an upper sleeve having a first end portion and a second end portion opposite to each other; the first end portion of the upper sleeve being disposed in the second end portion of the felt tip cap; the second end portion of the upper sleeve upward projecting from the felt tip cap and being formed of a plurality of openings; and the second end portion of the upper sleeve also being provided at an upper end thereof with a stopper having a centered through hole;

a lower sleeve having a first end portion and a second end portion opposite to each other; the first and the second end portion of the lower sleeve being fitted in the first end portion of the felt tip cap and the first end portion of the upper sleeve, respectively, and the second end portion of the lower sleeve having an upper inner end formed into an upward expanded conical bore;

an ink guiding core having a stem and a plug, the plug having an outer diameter larger than that of the stem and being located at a middle section of the stem; the stem having a first end portion and a second end portion opposite to each other, the first and the second end portion of the ink guiding core being projected into and received in the second end portion of the lower sleeve and the centered through hole on the upper sleeve, respectively; and the plug having a first side and a second side opposite to each other, the first side being formed into a conical body for closely but detachably fitting in the conical bore of the lower sleeve;

a spring being disposed between the second side of the plug and the stopper of the upper sleeve;

a barrel being externally fitted around the second end portion of the felt tip cap, and internally defining an ink reservoir communicable with the openings on the upper sleeve; and a felt tip having a first end portion and a second end portion opposite to each other; the first and the second end portion being clamped in place by the first end portion of the felt tip cap and the micro raised portions in the ink feeder, respectively; and the second end portion of the felt tip being abutted on the first end portion of the stem of the ink guiding core; and the ink feeder being mounted in a lower end of the first end portion of the lower sleeve.

The spring provides sufficient elastic force to always push the ink guiding core downward, so that the conical body of the ink guiding core is normally in tight contact with the conical bore of the lower sleeve. However, when using the felt tip of the ink pen to write, the conical body of the ink guiding core will be pushed by the felt tip to move upward and away from the conical bore of the lower sleeve to thereby open the conical bore. At this point, ink in the ink reservoir is allowed to sequentially flow through the openings of the upper sleeve and the conical bore of the lower sleeve to the ink feeder. The ink flowed to the ink feeder would then attach to the tiny ink feeding clearances and be fed to the felt tip for writing.

Preferably, the main body of the ink feeder has a first end portion and a second end portion opposite to each other. The first end portion of the main body has a lower end formed into a radially outward extended flange for abutting on the lower end of the first end portion of the lower sleeve, so that the ink feeder and the lower sleeve are firmly connected to each other.

Preferably, the second end portion of the main body of the ink feeder has an upward tapered outer peripheral wall surface to form a conical surface, allowing the ink feeder to be more easily introduced into the first end portion of the lower sleeve.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
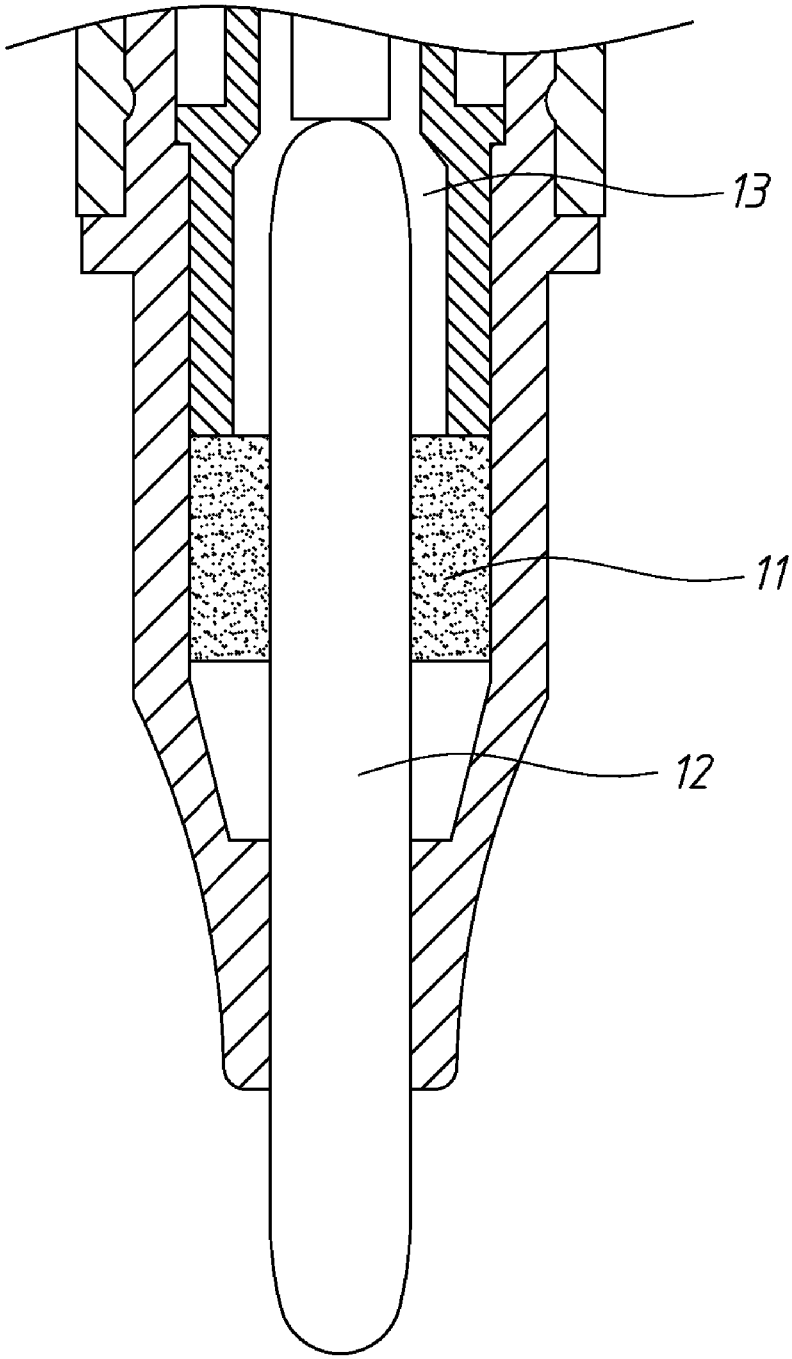
Fig. 1 (PRIOR ART)
FIG. 1 is a fragmentary longitudinal sectional view showing a conventional ink feeder mounted in a conventional felt-tip ink pen.
Figure 2:
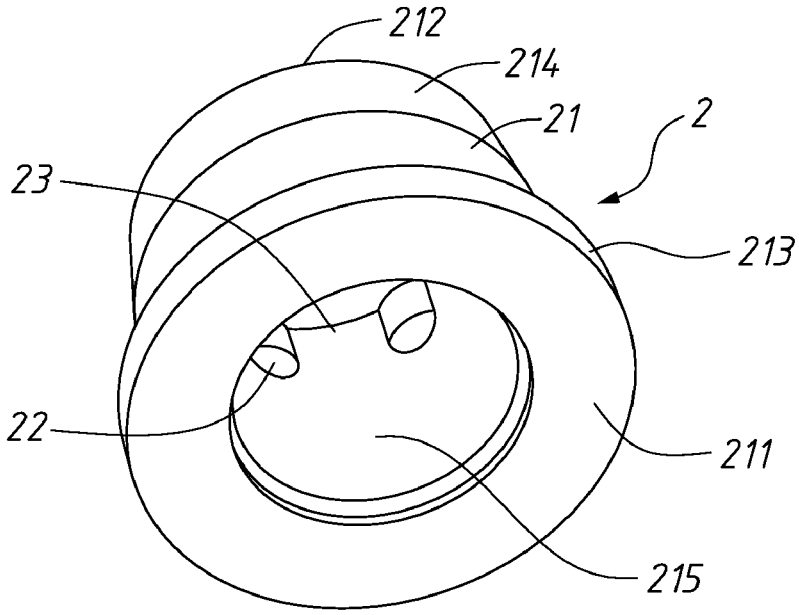
FIG. 2 is a bottom perspective view of an ink feeder for felt-tip ink pen according to a preferred embodiment of the present invention.
Figure 3:
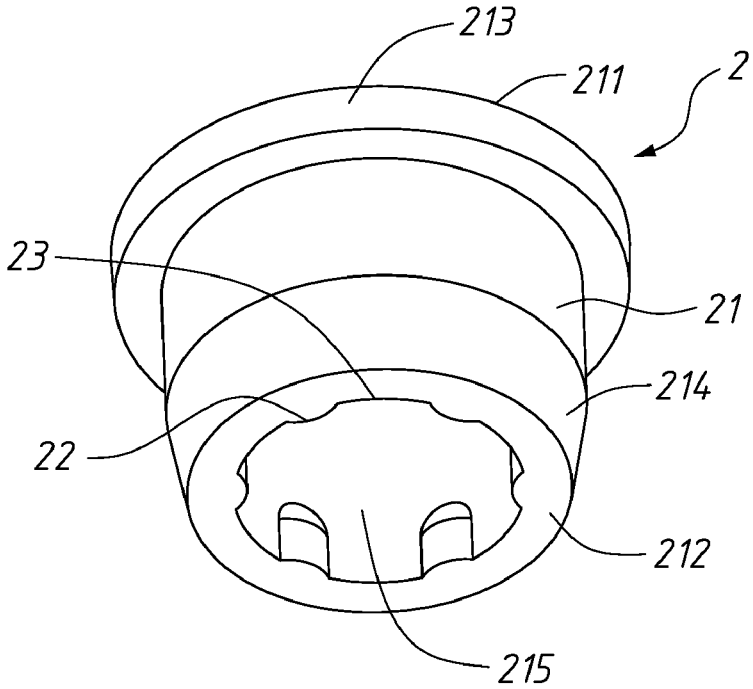
FIG. 3 is another perspective view of the ink feeder of the present invention in an upside-down position.

Please refer to FIGS. 2 and 3 that are two perspective views of an ink feeder 2 for felt-tip ink pen according to a preferred embodiment of the present invention, being viewed from two different view angles.

As can be seen from FIGS. 2 and 3, the ink feeder 2 includes a main body 21, a plurality of micro raised portions 22, and a plurality of ink feeding clearances 23.

The main body 21 is made of a rigid material, such as a plastic material, and has a first end portion 211 and a second end portion 212 opposite to each other. The first end portion 211 is formed at a lower end into a radially outward extended flange 213. An outer peripheral wall surface of the second end portion 212 is upward tapered to form a conical surface 214. The main body 21 internally defines a feeding bore 215.

A plurality of micro raised portions 22 is radially inward protruded from and circumferentially spaced along an inner wall surface of the main body 21. The micro raised portions 22 together clamp a length of a felt tip of the ink pen therebetween. An ink feeding clearances 23 is formed between any two adjacent micro raised portions 22 to communicate with the feeding bore 215, so that ink can be fed to the felt tip via the ink feeding clearances 23.

Figure 4:
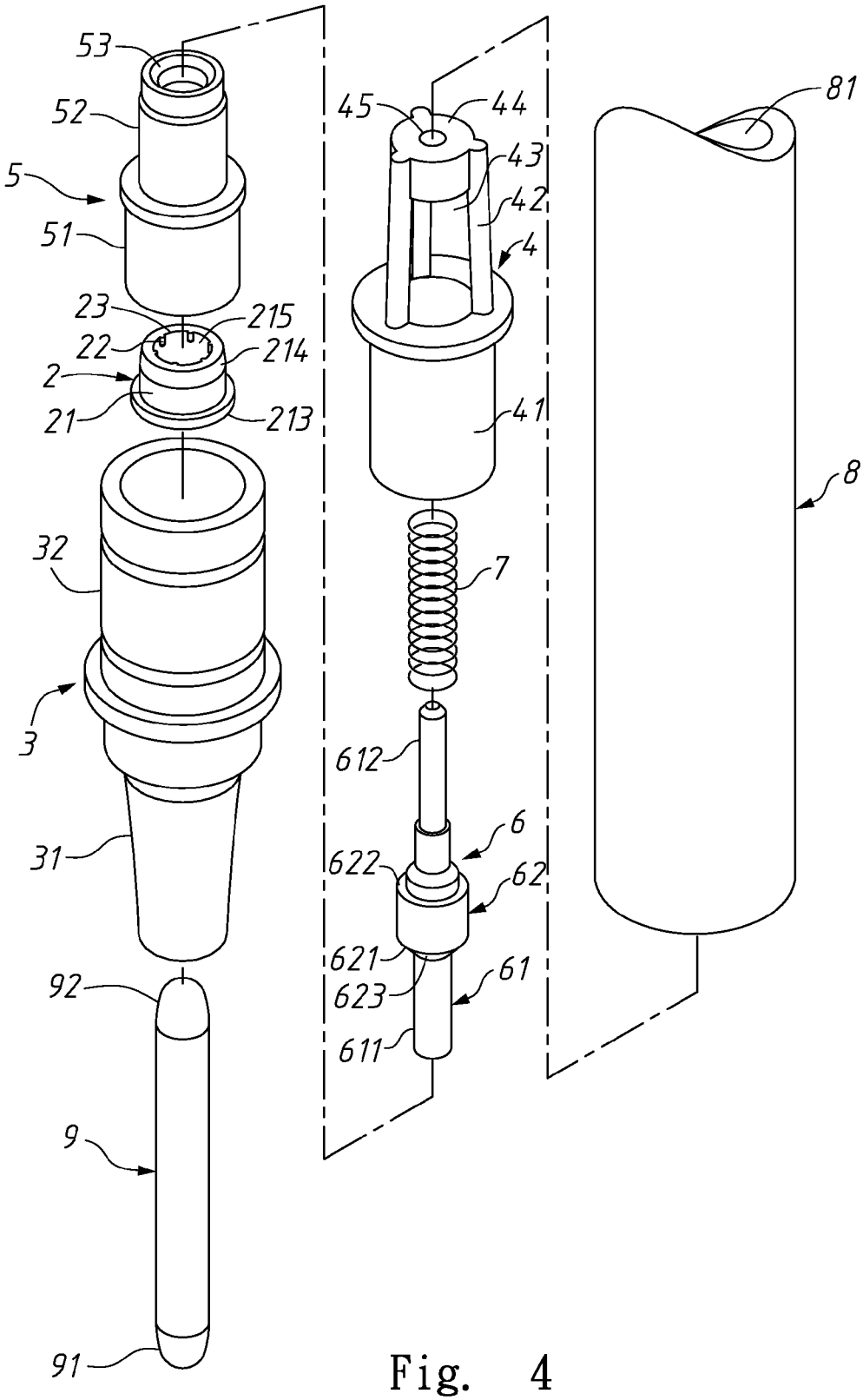
FIG. 4 is an exploded perspective view of an ink pen with which the ink feeder shown in FIGS. 2 and 3 is used.
Figure 5:
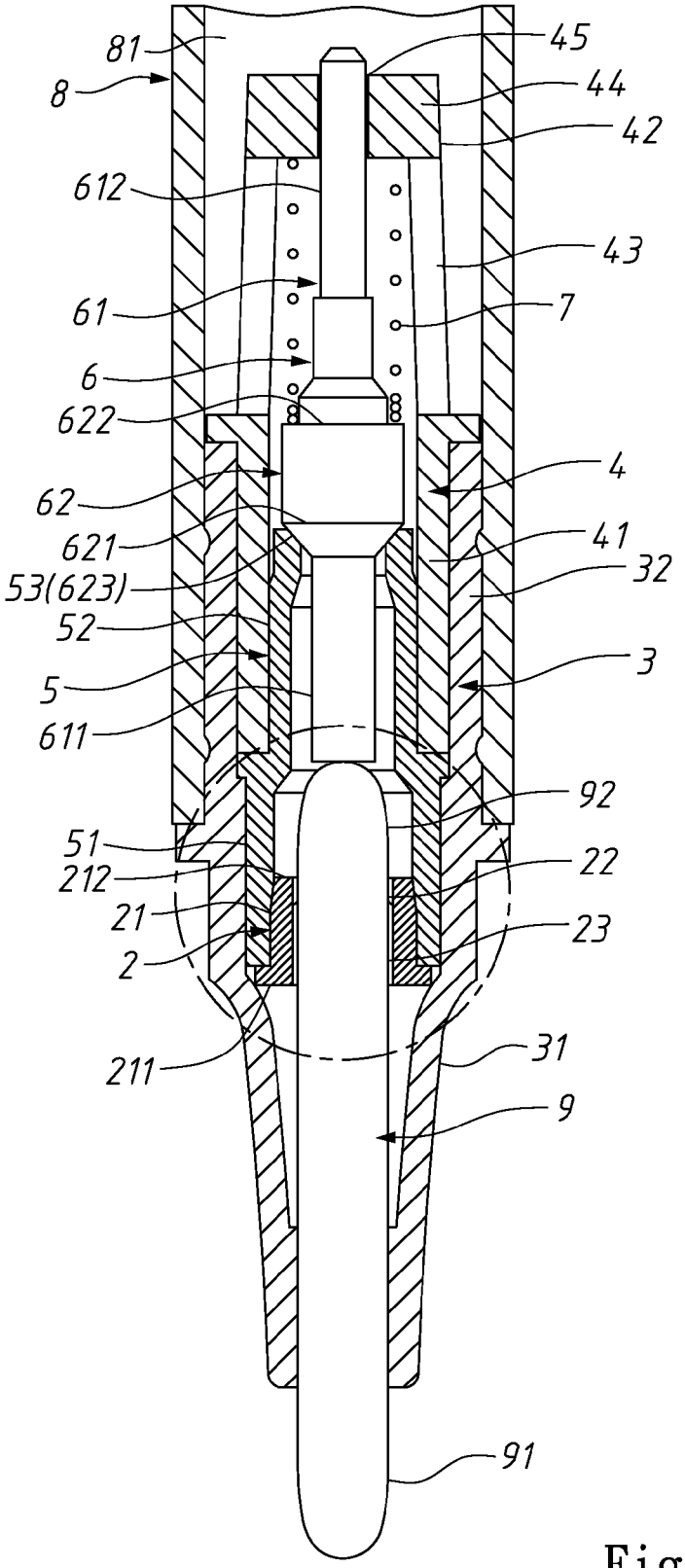
FIG. 5 is an assembled longitudinal sectional view of FIG. 4.
Figure 6:
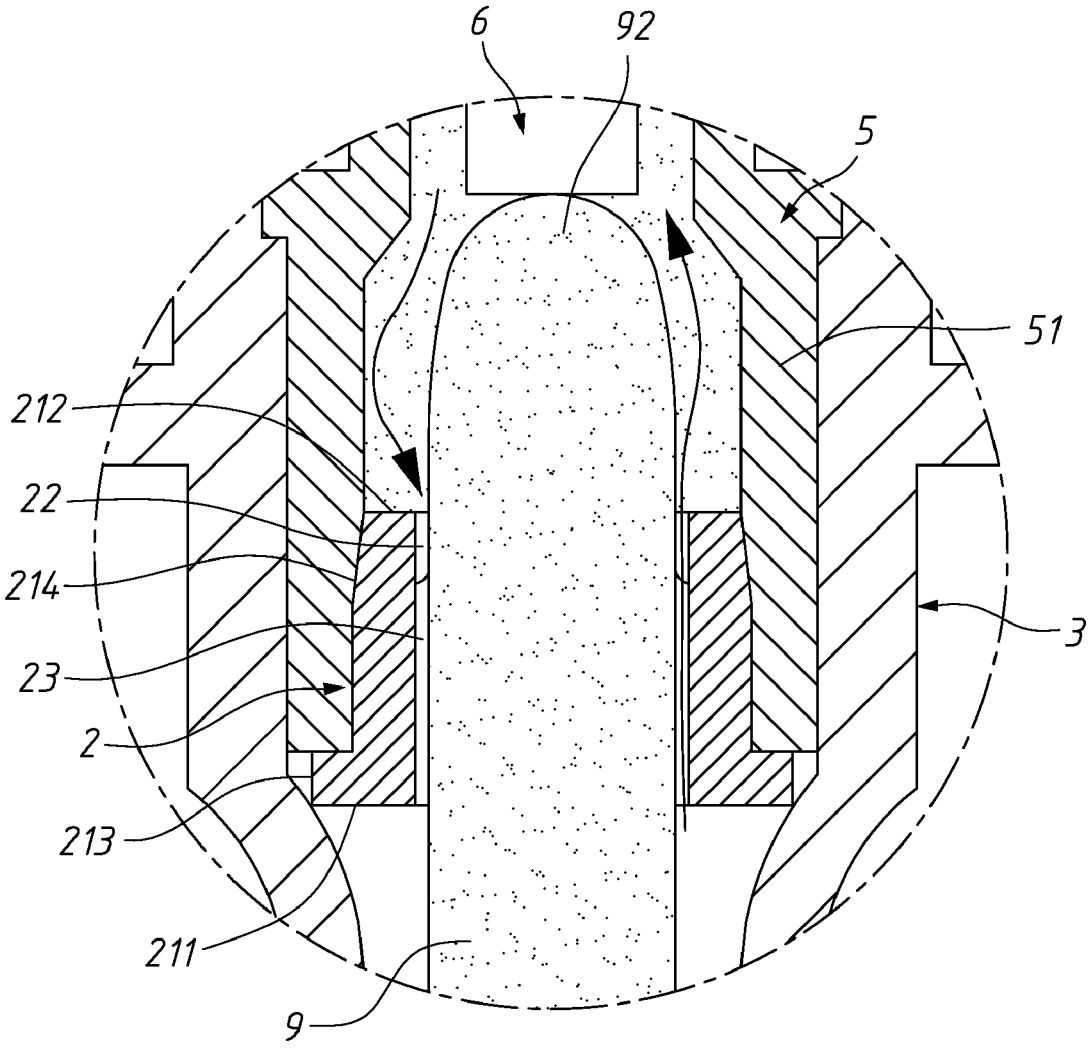
FIG. 6 is an enlarged view of the circled area in FIG. 5.

Please refer to FIGS. 4 and 5 that are exploded perspective view and assembled longitudinal sectional view, respectively, of a felt-tip ink pen with the ink feeder 2 of the present invention, and to FIG. 6 that is an enlarged view of the circled area in FIG. 5.

In a practical design of the felt-tip ink pen, there are included a felt tip cap 3, an upper sleeve 4, a lower sleeve 5, an ink guiding core 6, a spring 7, a barrel 8, and a felt tip 9.

The felt tip cap 3 has a first end portion 31 and a second end portion 32 opposite to each other.

The upper sleeve 4 has a first end portion 41 and a second end portion 42 opposite to each other. The first end portion 41 is fitted in the second end portion 32 of the felt tip cap 3. The second end portion 42 of the upper sleeve 4 upward projects from the felt tip cap 3, and is formed of a plurality of circumferentially spaced openings 43. A stopper 44 with a centered through hole 45 is provided at an upper end of the second end portion 42.

The lower sleeve 5 has a first end portion 51 and a second end portion 52 opposite to each other. The first and the second end portion 51, 52 of the lower sleeve 5 are fitted in the first end portion 31 of the felt tip cap 3 and the first end portion 41 of the upper sleeve 4, respectively. An upper inner end of the second end portion 52 of the lower sleeve 5 is formed into an upward expanded conical bore 53.

The ink guiding core 6 includes a stem 61 and a plug 62. The plug 62 has an outer diameter larger than that of the stem 61, and is located near a middle section of the stem 61. The stem 61 has a first end portion 611 and a second end portion 612 opposite to each other. The first end portion 611 is projected into and received in the second end portion 52 of the lower sleeve 5, and the second end portion 612 of the ink guiding core 6 is projected into and received in the through hole 45 of the upper sleeve 4. The plug 62 has a first side 621 and a second side 622 opposite to each other. The first side 621 of the plug 62 is formed into a conical body 623 for tightly but detachably fitting in the conical bore 53 of the lower sleeve 5.

The spring 7 is disposed between the second side 622 of the plug 62 of the ink guiding core 6 and the stopper 44 on the upper sleeve 4. When the ink guiding core 6 is upward pushed, the spring 7 provides an elastic force for the ink guiding core 6 to restore to an initial position. The spring 7 provides sufficient elastic force to push the ink guiding core 6 downward, so that the conical body 623 is normally in tight contact with the conical bore 53 of the lower sleeve 5.

The barrel 8 is externally fitted around the second end portion 32 of the felt tip cap 3. The barrel 8 internally defines an ink reservoir 81, which is communicable with the openings 43 on the upper sleeve 4.

The felt tip 9 is made of a fibrous material, and has a first end portion 91 and a second end portion 92 opposite to each other. The first and the second end portion 91, 92 are clamped in place by the first end portion 31 of the felt tip cap 3 and the micro raised portions 22 in the ink feeder 2. The second end portion 92 of the felt tip 9 is abutted on the first end portion 611 of the stem 61 of the ink guiding core 6.

The ink feeder 2 of the present invention is mounted in a lower end of the first end portion 51 of the lower sleeve 5 with the flange 213 abutted on the lower end of the first end portion 51 of the lower sleeve 5. The conical surface 214 on the ink feeder 2 enables the ink feeder 2 to be more easily introduced into the first end portion 51 of the lower sleeve 5.

Since the ink feeder 2 is made of a rigid material, it can be clamped and delivered with a machine without the risk of becoming deformed. Thus, the ink feeder 2 of the present invention and other ink pen components can be assembled together via a machine in an automated manner to largely save the time and labor needed to assemble the felt-tip ink pen.

When using the felt-tip ink pen to write, the first end portion 91 of the felt tip 9 is pressed against a paper, and the second end portion 92 of the felt-tip pen will be correspondingly pushed against the first end portion 611 of the stem 61 of the ink guiding core 6, forcing the conical body 623 of the plug 62 of the ink guiding core 6 to move upward and away from the conical bore 53 of the lower sleeve 5 to thereby open the conical bore 53. At this point, ink in the ink reservoir 81 is allowed to sequentially flow through the openings 43 of the upper sleeve 4 and the conical bore 53 of the lower sleeve 5 to the ink feeder 2. The ink flowed to the ink feeder 2 would then attach to the tiny ink feeding clearances 23 between the inner wall surface of the ink feeder 2 and the felt tip 9, so that the ink is temporarily stored in the ink feeder 2 for replenishing the felt tip 9 with ink when the latter is consumed during writing. That is, in the felt-tip ink pen, ink is fed from the ink feeding clearances 23 to the felt tip 9, so that a user can write with the felt tip 9.

The ink feeding clearances 23 is very tiny. As a capillary action thereof, the felt tip 9 is able to absorb the ink in the ink feeding clearances 23 for use. Therefore, the situation of leakage of ink due to a saturated ink feeder 2 can be avoided.

In addition to serve as ink feeding paths, the ink feeding clearances 23 on the ink feeder 2 also serve as paths to allow convection of air outside the ink pen and inside the ink reservoir 81, enabling smooth flowing and feeding of ink in the felt-tip ink pen.

With the above arrangements, the ink feeder according to the present invention can be easily handled in the process of automated assembling the ink pen, and is not subject to ink leakage to thereby provide very good applicability.

The present invention has been described with a preferred embodiment thereof and it is understood that many changes and modifications in the described embodiment can be carried out without departing from the scope and the spirit of the invention that is intended to be limited only by the appended claims.

What is claimed is:

1. An ink pen, comprising:

an ink feeder, the ink feeder comprising:

a main body being made of a rigid material to internally define a feeding bore;

a plurality of micro raised portions being radially inward protruded from and circumferentially spaced along an inner wall surface of the main body; and a plurality of ink feeding clearances each being formed between two adjacent ones of the micro raised portions and communicable with the feeding bore in the main body;

an ink reservoir communicable with the ink feeder;

a felt tip cap having a first end portion and a second end portion opposite to each other;

an upper sleeve having a first end portion and a second end portion opposite to each other; the first end portion of the upper sleeve being disposed in the second end portion of the felt tip cap; the second end portion of the upper sleeve upward projecting from the felt tip cap and being formed of a plurality of circumferentially spaced openings; and the second end portion of the upper sleeve also being provided at an upper end thereof with a stopper having a centered through hole;

a lower sleeve having a first end portion and a second end portion opposite to each other; the first end portion of the upper sleeve being fitted between the second end portion of the lower sleeve and the second end portion of the felt tip cap, and the second end portion of the lower sleeve having an upper inner end formed into an upward expanded conical bore;

an ink guiding core having a stem and a plug, the plug having an outer diameter larger than that of the stem and being located at a middle section of the stem; the stem having a first end portion and a second end portion on each side of the plug, the first and the second end portion of the stem of the ink guiding core being projected into and received in the second end portion of the lower sleeve and the centered through hole of the stopper, respectively; the plug having a first side and a second side opposite to each other, the first side being formed into a conical body for tightly but detachably fitting in the conical bore of the lower sleeve;

a spring being disposed between the second side of the plug and the stopper of the upper sleeve;

a barrel being externally fitted around the second end portion of the felt tip cap, and internally defining the ink reservoir communicable with the openings on the upper sleeve; and a felt tip having a first end portion and a second end portion opposite to each other; the first and the second end portion of the felt tip being clamped in place by the first end portion of the felt tip cap and between the micro raised portions in the ink feeder, respectively; and the second end portion of the felt tip being abutted on the first end portion of the ink guiding core;

wherein the ink feeder is mounted in a lower end of the first end portion of the lower sleeve; and ink stored in the ink reservoir is fed to the felt tip via the plurality of the ink feeding clearances of the ink feeder.

2. The ink pen as claimed in claim 1, wherein the main body of the ink feeder has a first end portion and a second end portion opposite to each other, the first end portion of the main body having a lower end formed into a radially outward extended flange for abutting on the lower end of the first end portion of the lower sleeve.

3. The ink pen as claimed in claim 2, wherein the second end portion of the main body has an upward tapered outer peripheral wall surface to form a conical surface.

* * * * *